US006609277B1

(12) United States Patent
Jaggi et al.

(10) Patent No.: US 6,609,277 B1
(45) Date of Patent: Aug. 26, 2003

(54) TEXTURING METHOD

(75) Inventors: Markus Jaggi, Moriken (CH); Heinz Von Arx, Meisterschwanden (CH)

(73) Assignee: Retech Aktiengesellschaft, Meisterschwanden (CH)

( * ) Notice: Subject to any disclaimer, the term of this patent is extended or adjusted under 35 U.S.C. 154(b) by 0 days.

(21) Appl. No.: 09/786,434

(22) PCT Filed: Aug. 25, 1999

(86) PCT No.: PCT/CH99/00392

§ 371 (c)(1),
(2), (4) Date: Mar. 2, 2001

(87) PCT Pub. No.: WO00/14313

PCT Pub. Date: Mar. 16, 2000

(30) Foreign Application Priority Data

Sep. 3, 1998 (CH) ..... 1806/98

(51) Int. Cl.[7] ..... D02J 1/00; D01H 7/92

(52) U.S. Cl. ..... 28/220; 28/247; 57/332; 57/337; 57/351

(58) Field of Search ..... 28/220, 247, 258, 28/271, 249, 262, 263; 57/282, 284, 287, 289, 332, 333, 334, 337, 341, 344, 351; 264/280, 282, 294, 345, 348

(56) References Cited

U.S. PATENT DOCUMENTS

| | | | | | |
|---|---|---|---|---|---|
| 3,381,461 A | | 5/1968 | Chubb | | |
| 4,329,841 A | * | 5/1982 | Mang | ..... | 57/288 |
| 4,464,894 A | * | 8/1984 | Leininger | ..... | 57/288 |
| 4,567,721 A | * | 2/1986 | Kuroda et al. | ..... | 57/284 |
| 4,905,468 A | * | 3/1990 | Tanae et al. | ..... | 57/291 |
| 5,438,820 A | * | 8/1995 | Nakahara et al. | ..... | 28/249 |
| 5,724,802 A | * | 3/1998 | Foster | ..... | 57/290 |
| 6,041,586 A | * | 3/2000 | Naylor et al. | ..... | 28/249 |
| 6,209,301 B1 | * | 4/2001 | Baader et al. | ..... | 57/332 |
| 6,408,607 B1 | * | 6/2002 | Nolle | ..... | 57/332 |
| 6,477,828 B1 | * | 11/2002 | Nolle | ..... | 57/332 |

FOREIGN PATENT DOCUMENTS

| | | |
|---|---|---|
| FR | 2 736 937 A | 1/1997 |
| GB | 735 027 A | 8/1955 |
| WO | WO 94 25651 A | 11/1994 |
| WO | WO 95 04175 A | 12/1995 |

* cited by examiner

*Primary Examiner*—Amy B. Vanatta
(74) *Attorney, Agent, or Firm*—Weingarten, Schurgin, Gagnebin & Lebovici LLP

(57) ABSTRACT

There is put forward a method for texturing thermoplastic yarns with which the thread before the provision of texture is brought to the necessary texturing temperature (T2) and during the actual texturing provision is cooled to a setting temperature (T23). The heating to the texturing temperature (T2) is effected in two steps. The actual texturing line (24) is provided with an active cooling, by which means the yarn is actively cooled to a setting temperature.

16 Claims, 2 Drawing Sheets

TEXTURING METHOD

The invention relates to a method for texturing a thermoplastic yarn, according to the preamble of the independent patent claim.

According to the newest method introduced onto the market a thermoplastic filament is removed from a roll overhead and by a delivery device is led to a heating box. The thread runs through a heating box, followed by a false twist unit, to a delivery device. The twist produced by the false twist unit after reaching the optimal plasticity effects a spiral-shaped deformation of the filament which subsequently is set by cooling, connected to the false twist unit the thread provided with a texture without twist via a thread detector reaches the winder and subsequently via an oiling device reaches the bobbin winder where the texturised thread is wound.

This method has the disadvantage that it requires a very long processing line which creates a texturing device with a very large constructional length and a complicated running course of the thread. Accordingly the processing speed is limited. This is amongst other things dependent on the speed and the quality of the heat provision into the thread within the heating box. So that the thread may be heated well and uniformly it must be within the heating box for a long time. This is achieved by the large constructional length of the heating box.

With the method according to the invention the processing speed is to be decisively increased.

An advantage of the invention lies in the fact that with the new method it is possible to construct a texturing device which is considerably less long and thus requires considerably less space.

An additional advantage lies in the fact that it is just because of the decisively shorter constructional manner that considerably larger run-through speeds may be reached.

A further advantage lies in the fact that one may have an influence on the specific properties of the thread.

The method according to the invention is hereinafter described in combination with the drawings.

Figure 1:
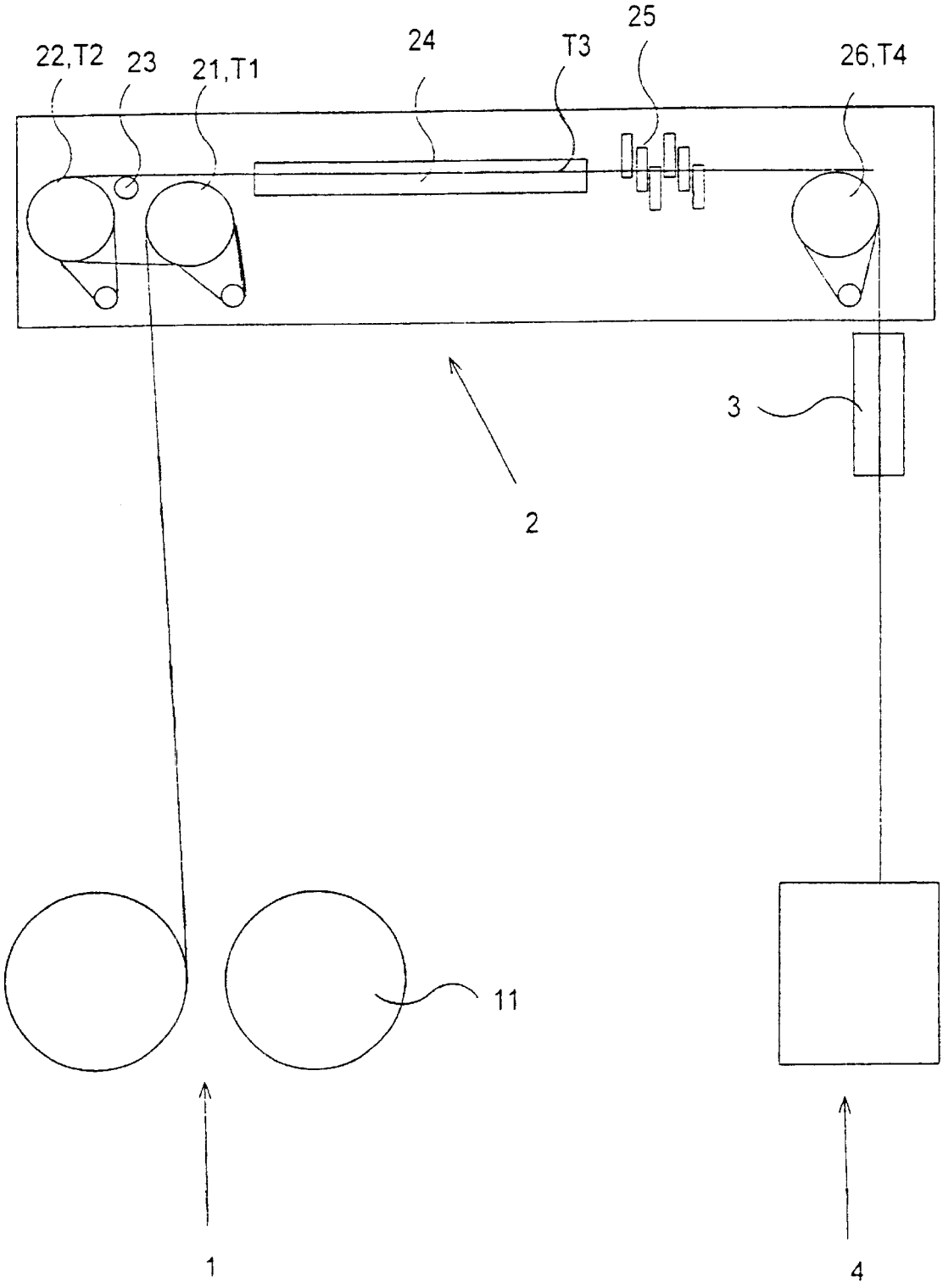
Figure 2:
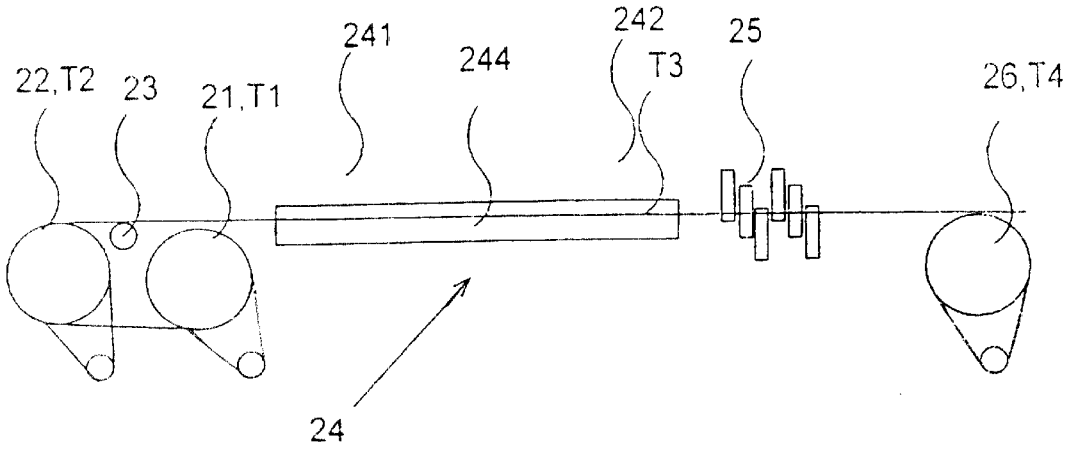
Figure 3:
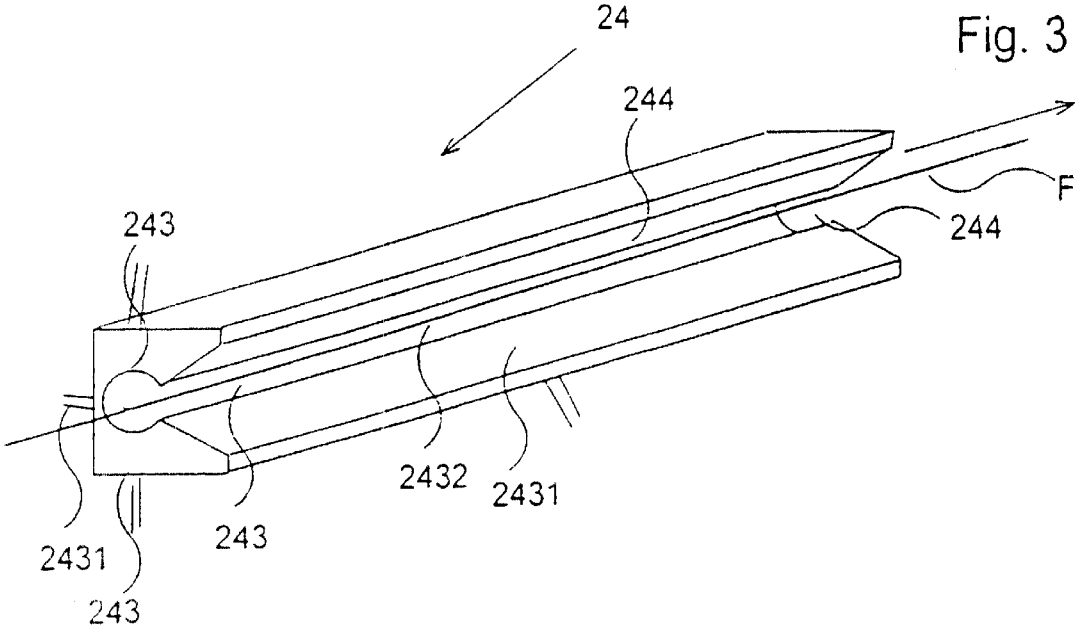

FIG. 1 shows the principle arrangement of the elements which make possible the new texturing method, FIG. 2 a special arrangement of the active cooling and FIG. 3 a further embodiment of the active cooling.

Raw yarn which is to be texturised, for example a thermoplastic filament, according to the conventional manner is brought onto spools 11, 11' to a loading station 1. From the feed station the raw yarn, normally wound off from the top, gets directly into a texturing module 2. After leaving the texturing module the completed texturised yarn is led to a winder station 4 where it is wound up. Between the texturing module 2 and the winder station 4 there may be arranged an oiling device 3.

The texturing module neither comprises a heating channel nor a pure feeding unit. These necessary functions are assumed by elements with other functions. The raw yarn in the texturing module 2 is firstly wound up at an input speed and heated to a preheat temperature T1. Subsequently the now pre-heated raw yarn is pre-drafted by a certain amount and then heated to the full texturing temperature T2. The completely heated yarn now obtains the texture in a cooled texturing line between a twist stop and a false twist organ. During the run-through through the texturing line the yarn is cooled to the setting temperature T3. Then the now texturised yarn reaches an elasticity correction station which brings the yarn to a selectable correction temperature T4. Thereupon the texturised yarn leaves the texturing module 2. It is supplied via the oiling device 3 to the winding station 4.

Decisive with this method is the two-step heating with a pre-drawing which is effected between these steps. This ensures an optimal heating of the raw yarn in its complete cross section and with all its filaments to the required texturing temperature T2. The texture by way of this is not incorporated during the heating but into a yarn which has the required temperature T2 already in its whole material. Thus in the texturing region already the setting of the texture in the yarn may be carried out in that in this texturing region the yarn is set already by active cooling to the setting temperature T3. The supply of the texture indeed is effected from the false twist organ running backwards to the twist stop and thus chiefly in the vicinity of the twist stop. Thus by way of the cooling, the setting of the texture is effected immediately without the material which has softened by the heat being mechanically loaded even further. The advantages of this method are evident and lie on the one hand in the significantly smaller constructional manner of a texturing device for texturing machines and on the other hand in the improved quality of the obtained texture thread.

An individual texturing device or texturing module 2 may now for example be constructed as is described in the following. At the input into the texturing module 2 the raw yarn reaches a first heating galette 21 which runs with a circumferential speed V1. This is wound round several times. With this the raw yarn is pulled flat on the surface of the first heating galette 21 and heated to the preheat temperature T1. In the case of the texturing of polypropylene the first heating galette 21 is however not heated, this means that it is sufficient for it to have roughly room temperature. These preheat temperatures T1 then permit the pre-drafting or the predrawing with the transfer to a second heating galette 22 which runs at a larger circumferential speed V2. Also the second heating galette 22 is wound round several times so that the material of the yarn is completely heated to the texturing temerature T2. Via a twist stop 23 the yarn goes through the texturing region 24 which is provided with a cooling line. The cooling line has near to the false twist unit 25 a lower temperature than at its run-in near to the twist stop 23. The cooling line brings the yarn at the end of the provision of the texture onto the yarn to the setting temperature T3, by which means the texture in the yarn is set. As a false twist unit 25 particularly suitable is a friction twist provider with a plurality of friction disks. Behind the false twist unit 25 then the texturised and twist-free yarn is pulled from a third heating galette 26 and transported further. After the third heating galette 26 there may be arranged further method zones. For example after the re-setting a further heater with a subsequent feeding unit may be applied. With this between the texturing and re-setting there may be incorporated an interlacing and folding process. Via a usual oiling device 3 the yarn reaches the winding station 4. With the third heating galette 26 the texturised yarn may in any case be heated so much until the elasticity in the yarn is reduced to a desired amount.

Likewise decisive is the active cooling during the texturing line 24. Likewise the cooling must be of a sufficient strength and able to be transferred to the yarn, wherein one must take particular consideration that the yarn during the whole production speed during the texturing is cooled to the necessary temperatures. For this not only is an air cooling suitable but also a fluid cooling with and without direct contact with the yarn. Further special possibilities are likewise provided so that the heat existing in the heated yarn may also be sufficiently removed by the cooling line. For example such a cooling channel may be filled or flushed with water, oil, coolant or liquid sodium or salt-containing medium, with a salt or salt mixture with a suitable melting temperature. Particularly suitable is of course the use of a coolant which vapourises in the prevailing temperature range of between roughly 50° and 300° C. At the same time the latent heat respectively the arising vapourisation cold considerably helps the yarn to lose sufficient heat in order to cool it to a suitable temperature within the texturing line 44. The cooling line may be provided with a cooling rail, a cooling channel, a cooling tube or likewise whose length may be adjusted for the purpose of optimisation. It is clear that the cooling rail must contain material with a good heat conductibility so that the heat removed from the yarn may also be transported way. It should also produce little friction and simultaneously be chemically stable.

In the variant as is shown in FIG. 2, at the beginning of the texturing line 24 there is arranged a spray unit 242. Here during the texturing process for example water is sprayed with the smallest droplets onto the yarn. These small droplets cool the yarn in that on vapourising they remove heat from the yarn. So that there remains no undesired residual dampness in the yarn, at the end of the active cooling line, thus shortly before the false twist organ 25 there may be applied a vacuum or arranged a suction chamber. By way of the vacuum the last part of sprayed on water vapourises or evaporates. Such a cooling with a direct yarn contact and a medium which removes much latent heat is of course particularly effective.

In a variant according to FIG. 3 there is shown an active air cooling. The texturing line comprises a cooling rail which is provided with a number of air nozzles 243. Cooling air, particularly also precooled air is via feed conduits 2431 blown to the air nozzles 243 and subsequently impinges the yarn F which is moved in the direction of the arrow through the cooling rail. Particularly suitable is an arrangement of an air nozzle 2432 which is arranged at an angle inclined to the running direction of the yarn and specifically against the running direction so that the air is blown from the colder part to the warmer part. Of course such air nozzles may be combined in a varying arrangement. Likewise blowing nozzles 234 may be combined with suctionings so that the throughput of air and thus the efficiency of the cooling of the yarn is optimised.

In FIG. 3 the cooling rail is also shown in a particularly suitable form. With this it is open laterally. This permits the device for the texturing method according to the invention to be provided with an automatic charging device. A robot arm with a suction pistol may automatically thread up a filament to be texturised. All elements of the texturing device are freely accessible from the side so that the robot arm may automatically pass through all stations.

By way of an additional arrangment of sensors for measuring the thread temperature and its on-line evaluation the heating and cooling may be controlled in an optimised manner to the texturing speed and to the type of the yarn to be texturised. Likewise a thread tension control with measurement and regulation may be important. For this a sensor for monitoring the thread tension is arranged in the region of the texturing line 24 and its readings are used for the control of the thread tension. By way of the mentioned control of the thread tension in the texturing region, a ballooning, i.e. oscillation of the yarn may at least be partly supressed respectively prevented. This is also possible by way of a particular design of the cooling line. For example the cooling channel may have a narrow free cross section or the yarn may be pulled over a cooling tube.

A texturing machine thus consists of a plurality of such texturing devices which each individually may be operated in an optimised manner. By way of this the flexibility of the texturing and the quality may be increased. With the multistage and individually controllable preheating and predrawing, combined with the active cooling in the texturing line, there results a decisively smaller construction of texturing machines than is possible today.

What is claimed is:

1. A method for the continuous texturing of a thermoplastic yarn amid the supply of heat, characterised in that a yarn pulled from a roll is first brought to a pre-heat temperature (T1), whereupon the pre-heated yarn is pre-drawn and after the pre-drawing is heated to a texturing temperature (T2), whereupon the, yarn on a texturing line between a twist stop and a false twist organ is provided with texture amid simultaneous cooling of the yarn to a fixation temperature (T3), and whereupon the texturised and set yarn is subsequently transported away with a pull-off.

2. A method according to claim 1, characterised in that the heating to the texturing temperature (T2) is effected in two steps.

3. A method according top claim 1, characterised in that subsequent to the texturing line there is effected a reduction in elasticity.

4. A method according to claim 1, characterised in that in the region of the texturing line the actual thread temperature is measured and its readings are used for the control of the pre-heating and the active cooling.

5. A device for the continuous texturing of a thermoplastic yarn amid the supply of heat with a yarn run-in and a yarn run-out and with a texturing line between a twist stop and a false twist organ, wherein the texturing line runs through a cooling channel, characterised in that between the yarn run-in and the twist stop there is present a two-stage heating, which comprises a first heating galette and a second heating galette, wherein the second heating galette comprises a higher temperature than the first heating galette and that the cooling channel is provided with an active cooling.

6. A device according to claim 5, characterised in that the false twist organ comprises a multitude of twist providing disks.

7. A device according to claim 5, characterised in that between the false twist organ and the yarn run-out there is arranged a third heating galette.

8. A device according to claim 5, characterised in that the rotary speeds and temperatures of the first, second and third heating galette are controllable.

9. A device according to claim 5, characterised in that the active cooling is an air cooling and comprises at least one air nozzle.

10. A device according to claim 9, characterised in that the air nozzle is an air nozzle which is inclined with respect to the running direction of the thread.

11. A device according to claim 5, characterised in that the active cooling is a fluid cooling and comprises a spray unit for spraying fluid onto the yarn.

12. A device according to claim 11, characterised in that the active cooling comprises a suction chamber for suctioning residual dampness from the yarn.

13. A device according to claim 5, characterised in that the cooling channel is open on one side.

14. A device according to claim 5, characterised in that there are arranged sensors for measuring the thread temperature in the region of the cooling channel.

15. A device according to claim 6, characterised in that the rotary speeds and temperatures of the first, secondhand third heating galette are controllable and the air nozzle is an air nozzle which is inclined with respect to the running direction of the thread.

16. A device according to claim 12, characterised in that the cooling channel is open on one side.

* * * * *

UNITED STATES PATENT AND TRADEMARK OFFICE

CERTIFICATE OF CORRECTION

PATENT NO. : 6,609,277 B1
DATED : August 26, 2003
INVENTOR(S) : Markus Jaggi et al.

It is certified that error appears in the above-identified patent and that said Letters Patent is hereby corrected as shown below:

Column 4,
Line 21, “active cooling” should read -- cooling. --;
Line 58, “6” should read -- 9 --;

Signed and Sealed this

Eighteenth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,609,277 B1
DATED : August 26, 2003
INVENTOR(S) : Markus Jaggi et al.

It is certified that error appears in the above-identified patent and that said Letters Patent is hereby corrected as shown below:

Column 4,
Line 38, “5” should read -- 7 --;
Line 41, “5” should read -- 8 --; and
Line 58, “6” should read -- 9 --.

Signed and Sealed this

Twenty-second Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,609,277 B1
DATED : August 26, 2003
INVENTOR(S) : Jaggi et al.

It is certified that error appears in the above-identified patent and that said Letters Patent is hereby corrected as shown below:

Column 4,
Line 59, "secondhand" should read -- second and --.

Signed and Sealed this

Ninth Day of May, 2006

JON W. DUDAS
*Director of the United States Patent and Trademark Office*